US008313153B2

(12) United States Patent
Maushart

(10) Patent No.: US 8,313,153 B2
(45) Date of Patent: Nov. 20, 2012

(54) ROTATABLE CUTTING TOOL AND TOOL HOLDER ASSEMBLY

(75) Inventor: Martin Maushart, Kettershausen (DE)

(73) Assignee: Kennametal Inc., Latrobe, PA (US)

( * ) Notice: Subject to any disclaimer, the term of this patent is extended or adjusted under 35 U.S.C. 154(b) by 381 days.

(21) Appl. No.: 12/730,561

(22) Filed: Mar. 24, 2010

(65) Prior Publication Data

US 2011/0233987 A1 Sep. 29, 2011

(51) Int. Cl.
*E21C 35/19* (2006.01)

(52) U.S. Cl. ..... 299/111; 299/113

(58) Field of Classification Search ..... 299/111, 299/113

See application file for complete search history.

(56) References Cited

U.S. PATENT DOCUMENTS

| | | | | |
|---|---|---|---|---|
| 3,256,043 | A * | 6/1966 | Krekeler | 299/108 |
| 3,397,012 | A | 8/1968 | Krekeler | |
| 3,397,013 | A * | 8/1968 | Krekeler | 299/105 |
| 4,627,665 | A | 12/1986 | Ewing et al. | |
| 5,605,382 | A | 2/1997 | Massa | |
| 5,607,206 | A | 3/1997 | Siddle et al. | |
| 5,720,528 | A | 2/1998 | Ritchey | |
| 5,921,562 | A * | 7/1999 | Robison | 279/128 |
| 6,478,383 | B1 | 11/2002 | Ojanen et al. | |
| 7,204,560 | B2 | 4/2007 | Mercier et al. | |
| 7,300,115 | B2 | 11/2007 | Holl et al. | |
| 7,458,646 | B2 | 12/2008 | Marathe et al. | |
| 2008/0284236 | A1 * | 11/2008 | Hall et al. | 299/105 |

* cited by examiner

*Primary Examiner* — John Kreck
(74) *Attorney, Agent, or Firm* — Matthew W. Smith, Esq.

(57) ABSTRACT

An assembly of a rotatable cutting tool and a tool holder is provided. The rotatable cutting tool includes a cutting tool body having a head portion at an axial forward end and a collar portion axially rearward of the head portion, and a shank portion axially rearward of the collar portion. Also included is a cap member positioned on the cutting tool body wherein the cap member has a base portion and a hard cutting tip affixed to the base portion. The tool holder includes a tool holder body containing a bore having a forward end and a rearward end. The rotatable cutting tool is rotatably retained in the bore of the tool holder body. In one aspect, the shank portion of the rotatable cutting tool is received in the bore of the tool holder body and means for lubricating the shank portion of the cutting tool body is provided. In another aspect, means for securing the cap member to the head portion is provided, for example magnetically securing the cap member to the head portion. In another aspect, means for preventing rotation of the cap member relative to the head portion is also provided.

11 Claims, 3 Drawing Sheets

ROTATABLE CUTTING TOOL AND TOOL HOLDER ASSEMBLY

BACKGROUND OF THE INVENTION

This invention relates to excavation cutting tools, and more particularly to a rotatable cutting tool and tool holder assembly wherein the rotatable cutting tool and tool holder assembly possesses an improved design so as to provide for improved performance and wear characteristics.

Excavation cutting tool assemblies to impinge earth strata (such as, for example, asphaltic roadway material or ore bearing or coal bearing earth formations or the like) typically comprise a cutting tool, sometimes referred to as a cutting bit or chisel, rotatably mounted within a cutting tool holder, sometimes referred to as a cutting tool sleeve, bit holder, bit sleeve, or chisel holder. In such assemblies, the cutting tool holder is mounted within a support block. The support block in turn is mounted onto a drum or other body, typically by welding, which in turn is driven by a suitable power means. When a number of such support blocks carrying respective cutting tool holders and cutting tools are mounted onto a drum or other body, and the drum or other body is driven, the cutting tools will engage and break up the material which is sought to be mined or removed. The general operation of such mining, road milling, or other such like machines is well known in the art.

Various types and designs of rotatable cutting tools have heretofore been used to impinge earth strata. Generally speaking, known types of rotatable cutting tools have an elongate cutting tool body, typically made from steel, and include a hard tip (or insert) affixed to the cutting tool body at the axial forward end thereof. The hard tip is typically made from a hard material such as, for example, cemented (cobalt) tungsten carbide.

As can be appreciated, during operation the entire rotatable cutting tool and tool holder is typically subjected to a variety of extreme cutting forces and stresses in an abrasive and erosive environment. It would be undesirable for the cutting tool body to prematurely wear or fail, whether it is through catastrophic fracture or the like or through abrasive or erosive wear. In such a circumstance, the rotatable cutting tool would have to be replaced prior to the normally scheduled time for replacement. Further, the premature failure of the rotatable cutting tool or the tool holder would negatively impact the cutting or milling efficiency of the overall earthworking apparatus. It thus becomes apparent that it is important that the cutting tool and tool holder possess the requisite design and strength to maintain its integrity during the intended useful life.

SUMMARY OF THE INVENTION

In accordance with an aspect of the invention, a rotatable cutting tool for use in impinging earth strata includes a cutting tool body and a cap member positioned on the cutting tool body. The cap member includes a base portion and a hard cutting tip affixed to the base portion. The cutting tool body has a head portion at an axial forward end and a collar portion axially rearward of the head portion, and a shank portion axially rearward of the collar portion. Also provided are means for magnetically securing the cap member to the head portion. In one aspect, the means for magnetically securing the cap member to the head portion includes a magnetic connection between the cap member and the head portion. In addition, means for lubricating the shank portion of the cutting tool body is provided. In one aspect, the means for lubricating the shank portion includes a lubrication fitting affixed to an axial rearward end of the shank portion.

In accordance with an aspect of the invention, a rotatable cutting tool for use in impinging earth strata includes a cutting tool body and a cap member positioned on the cutting tool body. The cap member includes a base portion and a hard cutting tip affixed to the base portion. The cutting tool body has a head portion at an axial forward end and a collar portion axially rearward of the head portion, and a shank portion axially rearward of the collar portion. Also provided are means for lubricating the shank portion of the cutting tool body.

In accordance with an aspect of the invention, a rotatable cutting tool for use in impinging earth strata includes a cutting tool body and a cap member positioned on the cutting tool body. The cap member includes a base portion and a hard cutting tip affixed to the base portion. The cutting tool body has a head portion at an axial forward end and a collar portion axially rearward of the head portion, and a shank portion axially rearward of the collar portion. Also provided are means for preventing rotation of the cap member relative to the head portion.

In accordance with another aspect of the invention, an assembly of a rotatable cutting tool and a tool holder is provided. The rotatable cutting tool includes a cutting tool body, the cutting tool body having a head portion at an axial forward end and a collar portion axially rearward of the head portion, and a shank portion axially rearward of the collar portion. Also included is a cap member positioned on the cutting tool body wherein the cap member has a base portion and a hard cutting tip affixed to the base portion. The tool holder includes a tool holder body containing a bore having a forward end and a rearward end. The rotatable cutting tool is rotatably retained in the bore of the tool holder body. In one aspect, the shank portion of the rotatable cutting tool is received in the bore of the tool holder body and means for lubricating the shank portion of the cutting tool body is provided.

In accordance with another aspect of the invention, an assembly of a rotatable cutting tool and a tool holder is provided. The rotatable cutting tool includes a cutting tool body, the cutting tool body having a head portion at an axial forward end and a collar portion axially rearward of the head portion, and a shank portion axially rearward of the collar portion. Also included is a cap member positioned on the cutting tool body wherein the cap member has a base portion and a hard cutting tip affixed to the base portion. The tool holder includes a tool holder body containing a bore having a forward end and a rearward end. The rotatable cutting tool is rotatably retained in the bore of the tool holder body. In one aspect, the shank portion of the rotatable cutting tool is received in the bore of the tool holder body and means for magnetically securing the cap member to the head portion is provided.

These and other aspects of the present invention will be more fully understood following a review of this specification and drawings.

DETAILED DESCRIPTION

Figure 1:
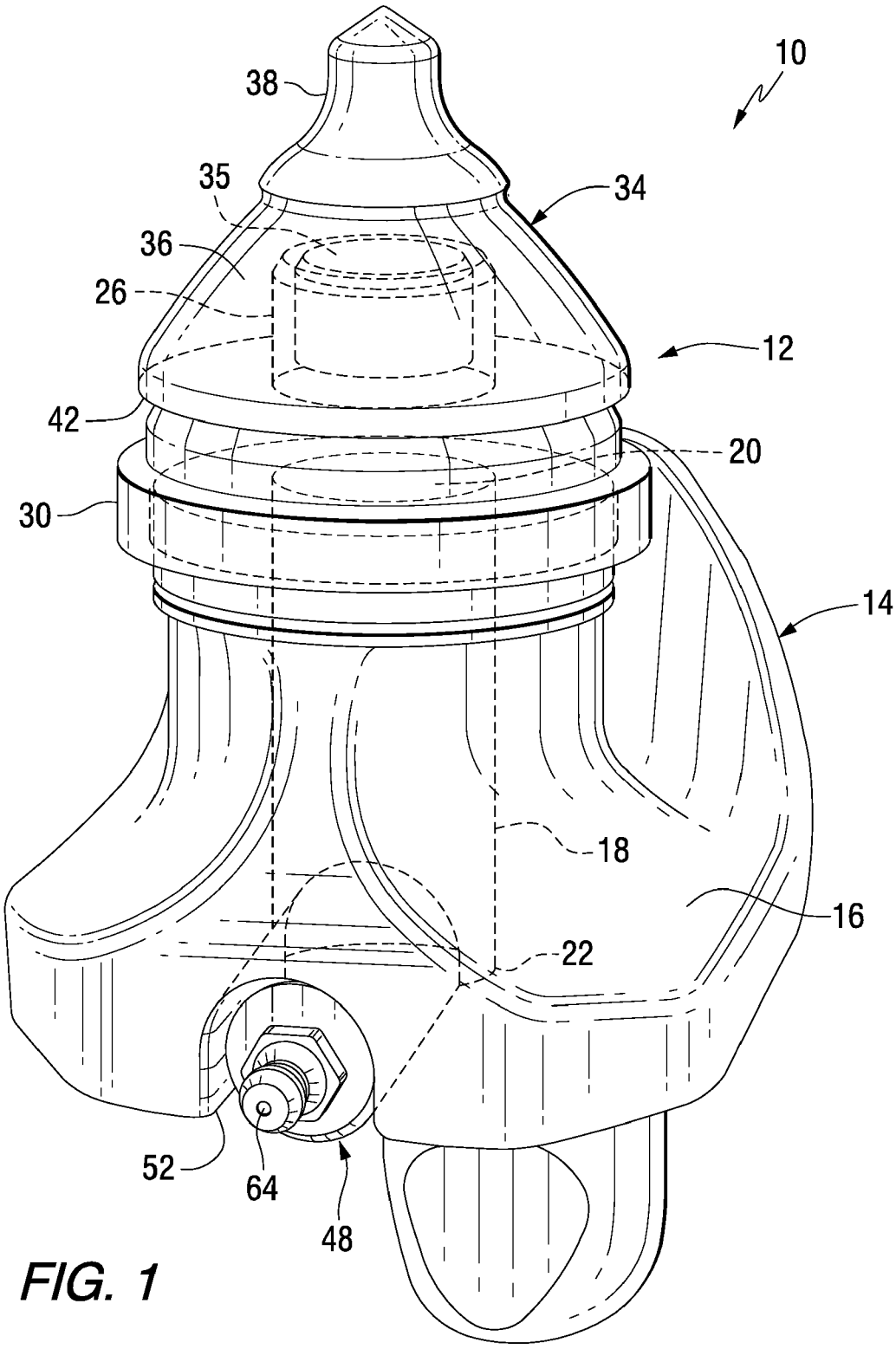
FIG. 1 is an isometric view of an assembly including a tool holder and rotatable cutting tool, in accordance with an aspect of the invention.
Figure 2:
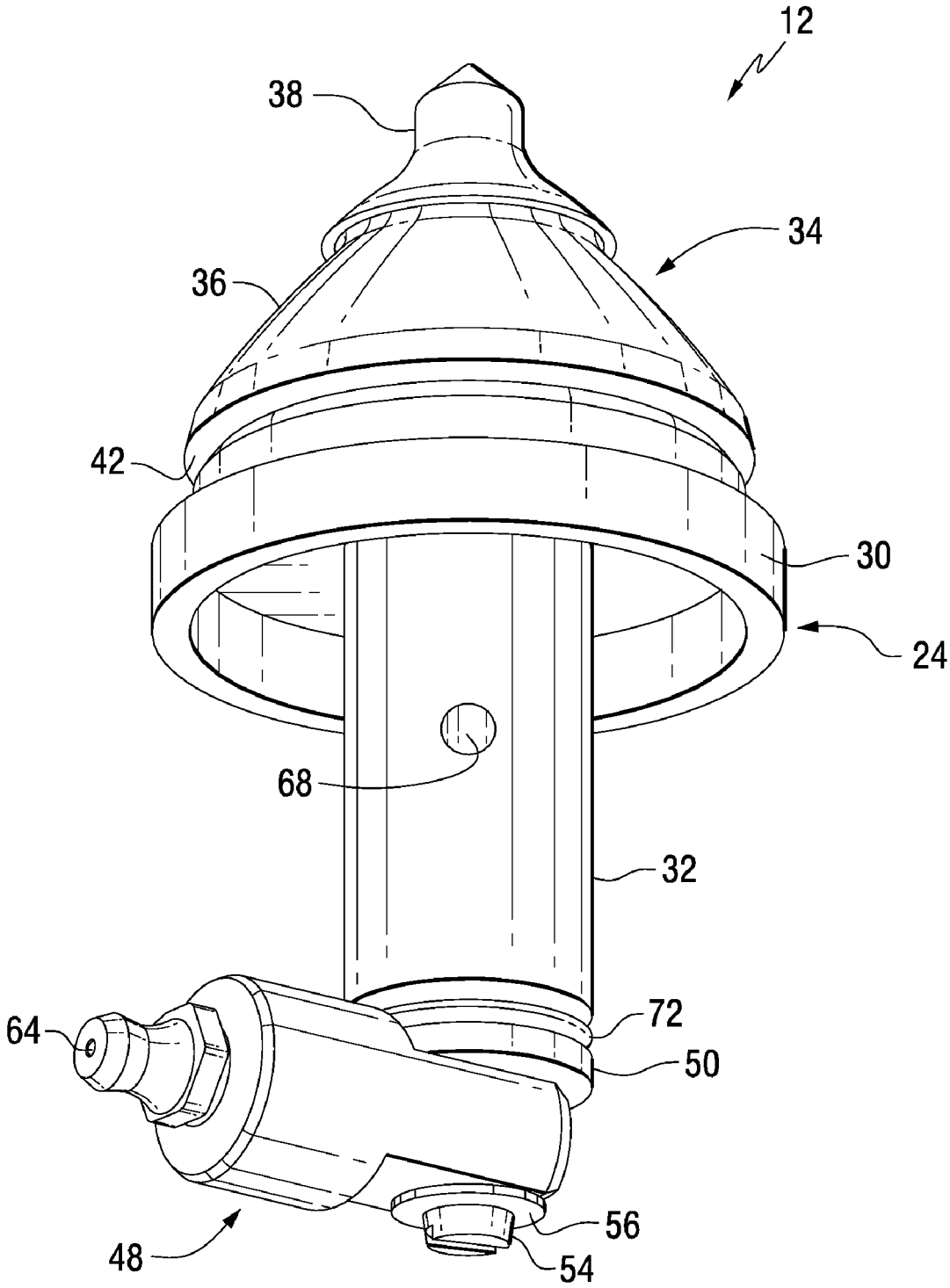
FIG. 2 is an isometric view of the rotatable cutting tool shown in FIG. 1, in accordance with an aspect of the invention.
Figure 3:
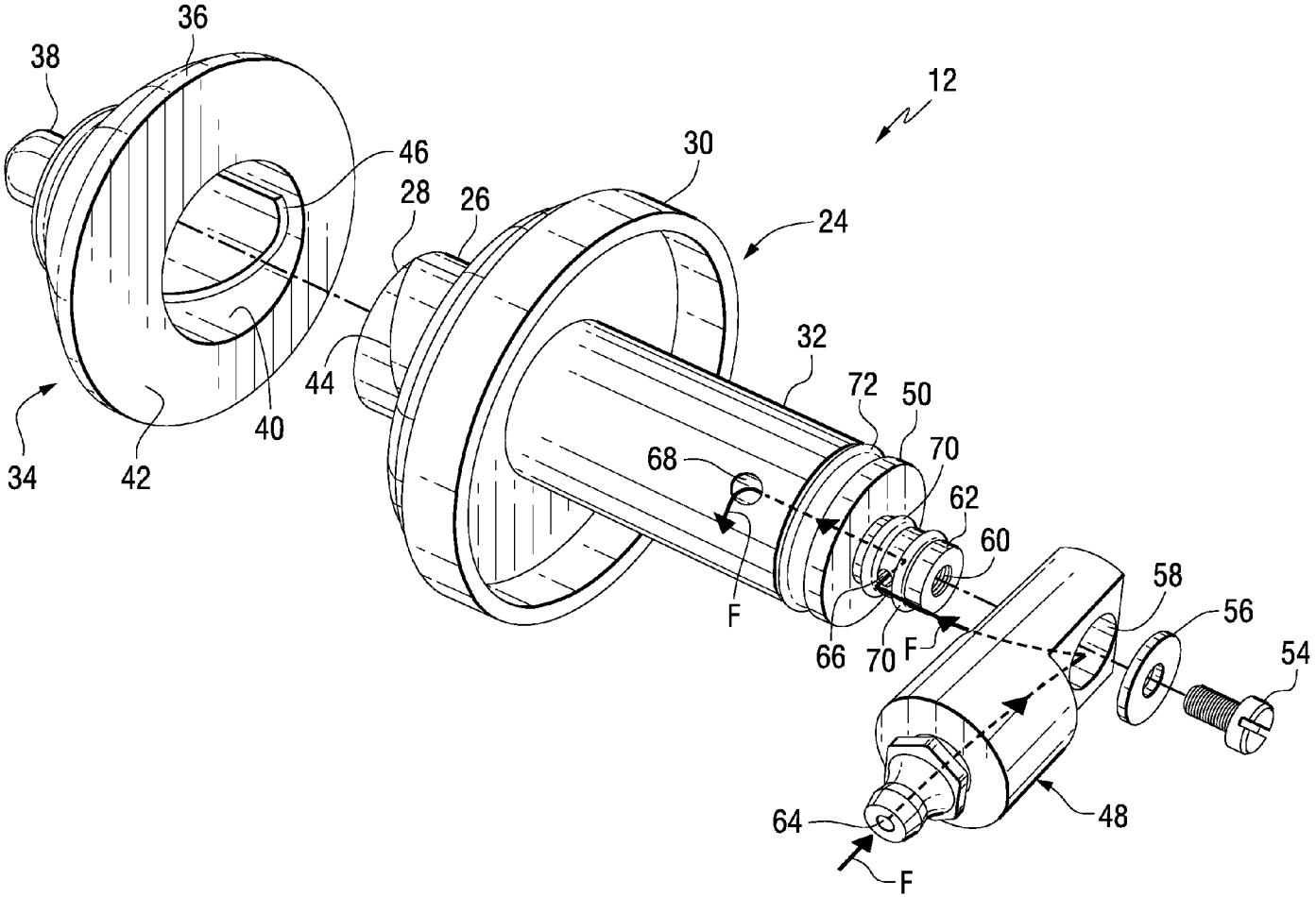
FIG. 3 is an exploded view of the rotatable cutting tool shown in FIGS. 1 and 2, in accordance with an aspect of the invention.

Referring to FIGS. 1-3, there is illustrated an assembly 10 that includes a rotatable cutting tool 12 and a tool holder 14, in accordance with an aspect of the invention. The cutting tool holder 14 is mounted within a support block (not shown) which in turn is mounted onto a drum or other similar body (not shown) of an excavation cutting tool assembly such as, for example, a mining, a road milling, or other such like machines as is well known in the art. The tool holder 14 includes a tool holder body 16 that contains a bore 18 having an axial forward end 20 and an axial rearward end 22. The rotatable cutting tool 12 is removably and rotatably retained in the tool holder 14, as will be described in more detail herein.

Still referring to FIGS. 1-3, the rotatable cutting tool 12 includes a cutting tool body, generally designated by reference number 24. The cutting tool body 24 includes a head portion 26 at an axial forward end 28 thereof, a collar portion 30 axially rearward of the head portion 26, and a shank portion 32 axially rearward of the collar portion 30.

The rotatable cutting tool 12 also includes a cap member 34 positioned on the head portion 26 of the cutting tool body 24. The cap member 34 has a base portion 36 and a hard cutting tip 38 affixed to the base portion 36. In one aspect of the invention, the hard cutting tip 38 is permanently affixed to the base portion 36 by, for example, the tip 38 being brazed onto the base portion 36. However, it will be appreciated that other configurations may be provided in accordance with other aspects of the invention such as, for example, releasably affixing the tip 38 to the base portion 36 so that the tip 38 can be replaced once it is worn out.

In one aspect of the invention, the base portion 36 of the cap member 34 defines an opening 40 (see FIG. 3) for receiving all or at least part of the head portion 26 of the cutting tool body 24. In another aspect of the invention, when the head portion 26 is received in the opening 40, an axial rearward end 42 of the base portion 36 is positioned on or adjacent the collar portion 30 of the cutting tool body 24.

The rotatable cutting tool 12 also may include means for securing the cap member 34 to the head portion 26. In one aspect of the invention, the means for securing the cap member 34 to the head portion 26 may include a magnetic connection between the cap member 34 and the head portion 26. In one aspect, at least a portion of the head portion 26 or the cap member 34 may be formed of magnetic materials for providing the magnetic connection between the cap member 34 and the cutting tool body 24. In another aspect, FIG. 1 illustrates a magnet 35 being installed, at least partially, into the head portion 26 by, for example, press fit or gluing the magnet 35 in place.

Referring to FIG. 3, the invention may also include means for preventing rotation of the cap member 34 relative to the head portion 26. In one aspect of the invention, an elongated groove 44 may be formed on an outer surface of the head portion 26 for cooperating with a notch 46 that is formed on an inner surface of the opening 40 of the cap member 34. The cooperation between the groove 44 and the notch 46 prevents the cap member 34 from being able to rotate relative to the cutting tool body 24. It will be appreciated that other means for preventing rotation between the cap member 34 and the head portion 26 of the cutting tool body 24 may also be provided in accordance with the invention.

Referring again to FIGS. 1-3, the invention may also include means for lubricating the shank portion 32 of the cutting tool body 24. Advantageously, by providing for lubrication of the shank portion 32, which is rotatably received in the bore 18 of the tool holder 14, the shank portion 32 experiences less wear and thus increases the overall life of the rotatable cutting tool 12.

In one aspect of the invention, the means for lubricating the shank portion 32 of the cutting tool body 24 may include a lubrication fitting 48 that is affixed or attached to an axial rearward end 50 of the shank portion 32 adjacent the axial rearward end 22 of the bore 18 of the tool holder body 24. The lubrication fitting 48 may be positioned, at least partially, in an opening 52 that is formed in the tool holder body 16 of the tool holder 14. In one aspect, the opening 52 may be an elongated channel for housing the fitting 48. In addition, the lubrication fitting 48 may be secured to the tool holder body 24 by, for example, a fastener such as, for example a bolt 54 and a washer 56 wherein the bolt 54 passes through a bore 58 formed in the lubrication fitting 48 and is received in a threaded opening 60 that is formed in a shank extension 62 formed adjacent the axial rearward end 50 of the shank portion 32. It will be appreciated that other means may be provided for securing the lubrication fitting 48 to the cutting tool body 24 in accordance with aspects of the invention. In addition, it will be appreciated that the means for securing the lubrication fitting 48 to the rotatable tool body 24 provides for the cutting tool body 24, and more specifically the shank portion 32, to remain able to rotate within the bore 18 of the tool holder 14 during operation of the assembly 10.

To provide for the lubrication of the shank portion 32 of the cutting tool body 24, a lubricant such as, for example, oil or grease is inserted through an inlet or nipple 64 of the lubrication fitting 48 in a manner that is generally known. The inlet 64 is in fluid communication with the opening 68 formed on the shank portion 32. Specifically, the lubricant follows the flow path F through the fitting 48 to the bore 58 where the lubricant enters the opening 66 in the shank extension 62. O-rings 70 are provided on the shank extension 62 to assist in directing the flow of lubricant into the opening 66. The lubricant then continues to follow the flow path F and is dispersed through the opening 68 onto the shank portion 32 and thus provide for the lubrication of the shank portion 32. O-ring 72 is provided on the shank portion 32 to maintain the lubricant on the shank portion 32. It will be appreciated that the opening 66 and opening 68 are in communication with the threaded opening 60 that continues internally through the shank extension 62 and the axial rearward end 50 of the shank portion 32.

Whereas particular embodiments of this invention have been described above for purposes of illustration, it will be evident to those skilled in the art that numerous variations of the details of the present invention may be made without departing from the invention as defined in the appended claims.

What is claimed is:

1. A rotatable cutting tool for use in impinging earth strata, the rotatable cutting tool comprising:

a cutting tool body having a head portion at an axial forward end, a collar portion axially rearward of the head portion, and a shank portion axially rearward of the collar portion;

a cap member positioned on the head portion of the cutting tool body, the cap member having a base portion and a hard cutting tip affixed to the base portion; and means for magnetically securing the cap member to the head portion.

2. The rotatable cutting tool of claim 1, wherein the base portion of the cap member defines an opening for receiving the head portion of the cutting tool body.

3. The rotatable cutting tool of claim 2, wherein the means for magnetically securing the cap member to the head portion includes a magnet positioned at least partially in the head portion.

4. The rotatable cutting tool of claim 2, wherein the means for magnetically securing the cap member to the head portion includes forming at least a portion of the head portion or the cap member of a magnetic material.

5. The rotatable cutting tool of claim 2, further including means for preventing rotation of the cap member relative to the head portion.

6. The rotatable cutting tool of claim 1, further including means for lubricating the shank portion of the cutting tool body.

7. The rotatable cutting tool of claim 6, wherein the means for lubricating the shank portion includes a lubrication fitting affixed to an axial rearward end of the shank portion.

8. The rotatable cutting tool of claim 1, wherein an axial rearward end of the base portion is positioned on the collar portion of the cutting tool body.

9. An assembly of a rotatable cutting tool and a tool holder, the assembly comprising:

a rotatable cutting tool including a cutting tool body, the cutting tool body having a head portion at an axial forward end, a collar portion axially rearward of the head portion, and a shank portion axially rearward of the collar portion;

a cap member positioned on the cutting tool body, the cap member having a base portion and a hard cutting tip affixed to the base portion;

a tool holder including a tool holder body containing a bore having a forward end and a rearward end;

the rotatable cutting tool being rotatably retained in the bore of the tool holder body; and means for magnetically securing the cap member to the head portion.

10. The assembly of claim 9, further including means for preventing rotation of the cap member relative to the head portion.

11. The assembly of claim 9, further including means for lubricating the shank portion of the cutting tool body.

* * * * *